US005471737A

United States Patent [19]

McWilliams

[11] Patent Number: 5,471,737

[45] Date of Patent: Dec. 5, 1995

[54] METHOD OF MANUFACTURING A RADIANT ELECTRIC HEATER

[75] Inventor: Joseph A. McWilliams, Droitwich, United Kingdom

[73] Assignee: Ceramaspeed Limited, United Kingdom

[21] Appl. No.: 192,996

[22] Filed: Feb. 8, 1994

[30] Foreign Application Priority Data

Feb. 11, 1993 [GB] United Kingdom ..... 9302688

[51] Int. Cl.[6] ..... H05B 3/00; H05B 3/68

[52] U.S. Cl. ..... 29/611; 29/848; 29/850; 219/457; 219/464

[58] Field of Search ..... 29/611, 613, 846, 29/848, 850; 219/457–460, 463, 464, 467

[56] References Cited

U.S. PATENT DOCUMENTS

| | | | |
|---|---|---|---|
| 2,570,975 | 10/1951 | Osterheld | 219/37 |
| 3,612,829 | 10/1971 | Evans et al. | 219/464 |
| 3,986,416 | 10/1976 | Wade | 83/1 |
| 4,292,504 | 9/1981 | Gebarowski et al. | 219/542 |
| 4,713,527 | 12/1987 | Kicherer et al. | 219/464 |
| 4,789,773 | 12/1988 | Mikschl | 219/463 |

FOREIGN PATENT DOCUMENTS

| | | |
|---|---|---|
| 2740163 | 9/1978 | Germany . |
| 3539881 | 5/1987 | Germany . |
| 3527413 | 12/1987 | Germany . |
| 1569588 | 6/1980 | United Kingdom . |

*Primary Examiner*—P. W. Echols
*Attorney, Agent, or Firm*—Ira S. Dorman

[57] ABSTRACT

A radiant electric heater is manufactured by a method which involves providing a base of microporous thermal and electrical insulation material having a substantially continuous surface, and providing a heating element in the form of an elongate electrically conductive strip. The strip is urged edgewise into the continuous surface of the base of microporous thermal and electrical insulation material so as to embed and support the strip edgewise in the insulation material along substantially the entire length of the strip to a depth corresponding to at least part of the height of the strip.

8 Claims, 3 Drawing Sheets

METHOD OF MANUFACTURING A RADIANT ELECTRIC HEATER

This invention relates to a method of manufacturing a radiant electric heater and, more particularly but not exclusively, relates to a method of manufacturing a radiant electric heater for use with a glass-ceramic smooth top cooker.

BACKGROUND TO THE INVENTION

Radiant electric heaters are known in which an element of coiled bare electric resistance wire is supported on, and secured by staples to, a layer of microporous thermal and electrical insulating material compacted in a metal support dish. Such heaters are described, for example, in GB-A-1 580 909 and are incorporated in glass-ceramic smooth top cookers.

The term 'microporous' is used herein to identify porous or cellular materials in which the ultimate size of the cells or voids is less than the mean free path of an air molecule at NTP, i.e. of the order of 100 nm or smaller. A material which is microporous in this sense will exhibit very low transfer of heat by air conduction (that is collisions between air molecules). Such microporous materials include aerogel, which is a gel in which the liquid phase has been replaced by a gaseous phase in such a way as to avoid the shrinkage which would occur if the gel were dried directly from a liquid. A substantially identical structure can be obtained by controlled precipitation from solution, the temperature and pH being controlled during precipitation to obtain an open lattice precipitate. Other equivalent open lattice structures include pyrogenic (fumed) and electro-thermal types in which a substantial proportion of the particles have an ultimate particle size less than 100 nm. Any of these particulate materials, based for example on silica, alumina or other metal oxides, may be used to prepare a composition which is microporous as defined above.

The microporous insulation typically comprises a dry particulate microporous material as defined hereinabove mixed with ceramic fibre reinforcement, titanium dioxide opacifier and, for high-temperature use, a small quantity of alumina powder to resist shrinkage. Such insulation material is described in GB-A-1 580 909.

Radiant electric heaters have also been proposed in which, instead of an element of coiled resistance wire, an element comprising an elongate electrically conductive strip of a metal or metal alloy is provided, the element being supported on edge on an insulating base. Arrangements of this kind are described, for example, in U.S. Pat. Nos. 600,057, 3,612,829, 3,991,298, 4,161,648 and 4,292,504. In U.S. Pat. No. 600,057, a conductor is mounted on a metal support, or in a groove formed therein, by means of a coating of insulating material such as a vitreous enamel. In U.S. Pat. No. 3,612,829, a convoluted conductive strip element in the form of a spiral is located in recesses pre-formed in the surface of a cast or molded fibrous ceramic refractory material. Staples are used to secure the strip element to the supporting base. In U.S. Pat. No. 3,991,298, the conductive strip element is in the form of a spiral and is loose fitted in a pre-formed spiral groove in a rigid base of fire-resistant mortar.

In U.S. Pat. No. 4,161,648, a convoluted strip element of spiral form is provided with integral downwardly-extending mounting tabs which penetrate an electrically insulating sheet of high-temperature-withstanding board material. In the case of a thin sheet of board material, the mounting tabs are bent over at the back of the material. The board-like insulating sheet with the element thereon is then located on top of a layer of microporous thermal insulation material in a supporting dish. In the case of a thick sheet of board material, a hardenable substance is used and is hardened after the tabs have been urged into the material.

In U.S. Pat. No. 4,292,504, a heating element in the form of a thin, foil-like strip of expanded metal is supported on edge substantially along its entire length in a serpentine groove formed in the upper surface of a ceramic fibreboard. The heating element is cemented or held by friction in the groove formed in the board. It will be appreciated that a surface having a groove formed therein is not a substantially continuous surface.

OBJECT OF THE INVENTION

It is an object of the present invention to provide a method of manufacturing a radiant heater in which an elongate electrically conductive strip heater element is secured directly to a base of thermal and electrical insulation material.

SUMMARY OF THE INVENTION

According to the present invention there is provided a method of manufacturing a radiant electric heater comprising: providing a base of microporous thermal and electrical insulation material having a substantially continuous surface; providing a heating element in the form of an elongate electrically conductive strip having a predetermined height; and urging the strip edgewise into the continuous surface of the base of microporous thermal and electrical insulation material so as to embed and support the strip edgewise therein along substantially the entire length of the strip to a depth corresponding to at least part of the height of the strip. Surprisingly, in view of the particulate nature of the microporous insulation material, the heating element when urged into the material remains securely located during subsequent operation of the heater and no further securing means or process is required.

Preferably, the electrically conductive strip is of corrugated (also known as sinuous, serpentine or convoluted) form along its length.

The strip is preferably embedded to the extent that a significant proportion of the height thereof protrudes from the base of microporous insulation material.

The base of microporous insulation material is suitably provided as a compacted layer inside a supporting dish, suitably of metal.

The base of microporous insulation material may be formed with a surface of substantially planar form into which the strip is urged.

The provision of the compacted layer may, if desired, involve more than one process stage. In a first stage, the base may be formed by compacting the layer of microporous insulation material in the dish to less than its desired final compaction density; and then in a second stage during or after urging the strip into the base, further compaction of the microporous insulation material may be effected to obtain the desired final compaction density for the base.

The strip may comprise a metal, or metal alloy, such as an iron-chromium-aluminium alloy.

Suitable microporous thermal and electrical insulation materials are well-known in the art, for example as described in GB-A-1 580 909, a typical composition being:

| | |
|---|---|
| Microporous pyrogenic silica | 49 to 97% by weight |
| Ceramic fibre reinforcement | 0.5 to 20% by weight |
| Opacifier | 2 to 50% by weight |
| Alumina | up to 12% by weight |

The proportion of alumina is preferably in the range from 0.5 to 12 percent by weight.

The invention is now described by way of example with reference to the accompanying drawings in which:

DESCRIPTION OF PREFERRED EMBODIMENTS

A radiant heater is constructed comprising a metal dish 1 containing a base layer 2 of compacted microporous thermal and electrical insulation material, having a substantially planar surface and having a composition such as that described in GB-A-1 580 909.

Figure 1:
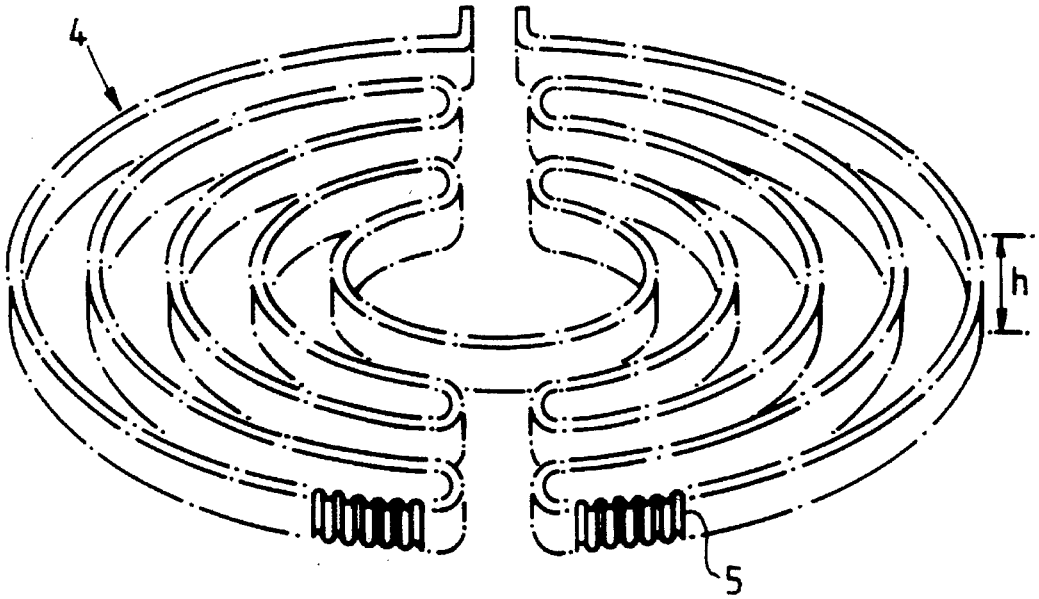
FIG. 1 is a perspective view of a heating element comprising an electrically conductive strip for use in the method according to the present invention.
Figure 4:
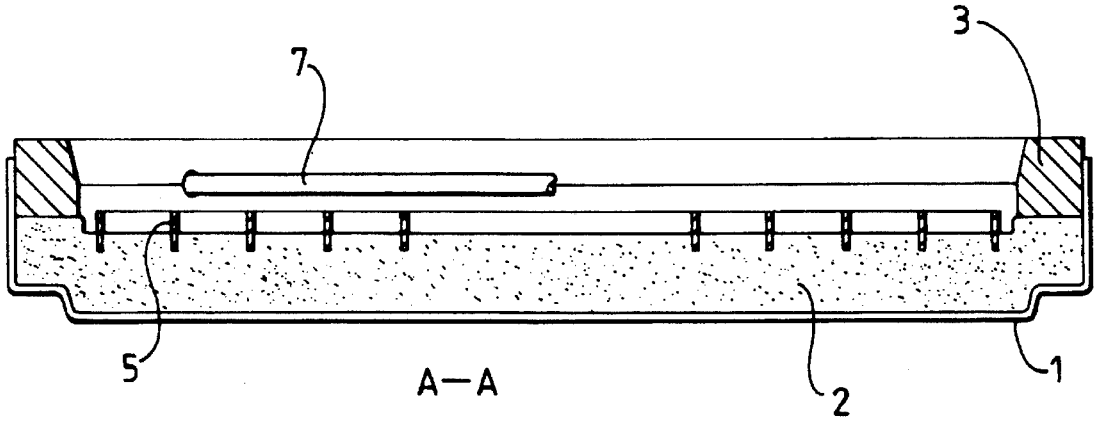
FIG. 4 is a cross-sectional view of the radiant electric heater of FIG. 3.
Figure 2:
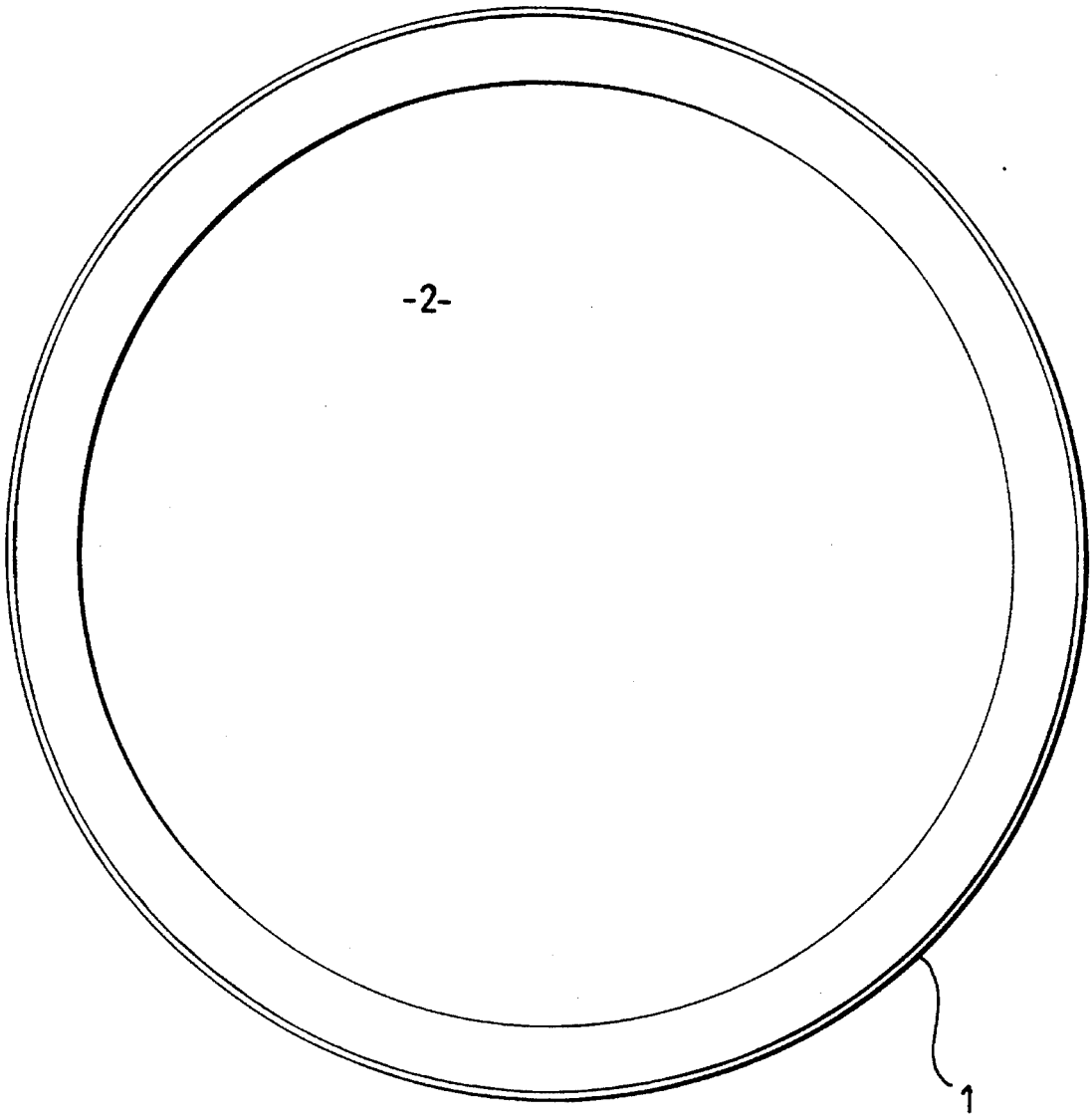
FIG. 2 iS a plan view of a base of a radiant electric heater for use in the present invention, for receiving the heating element of FIG. 1.
Figure 3:
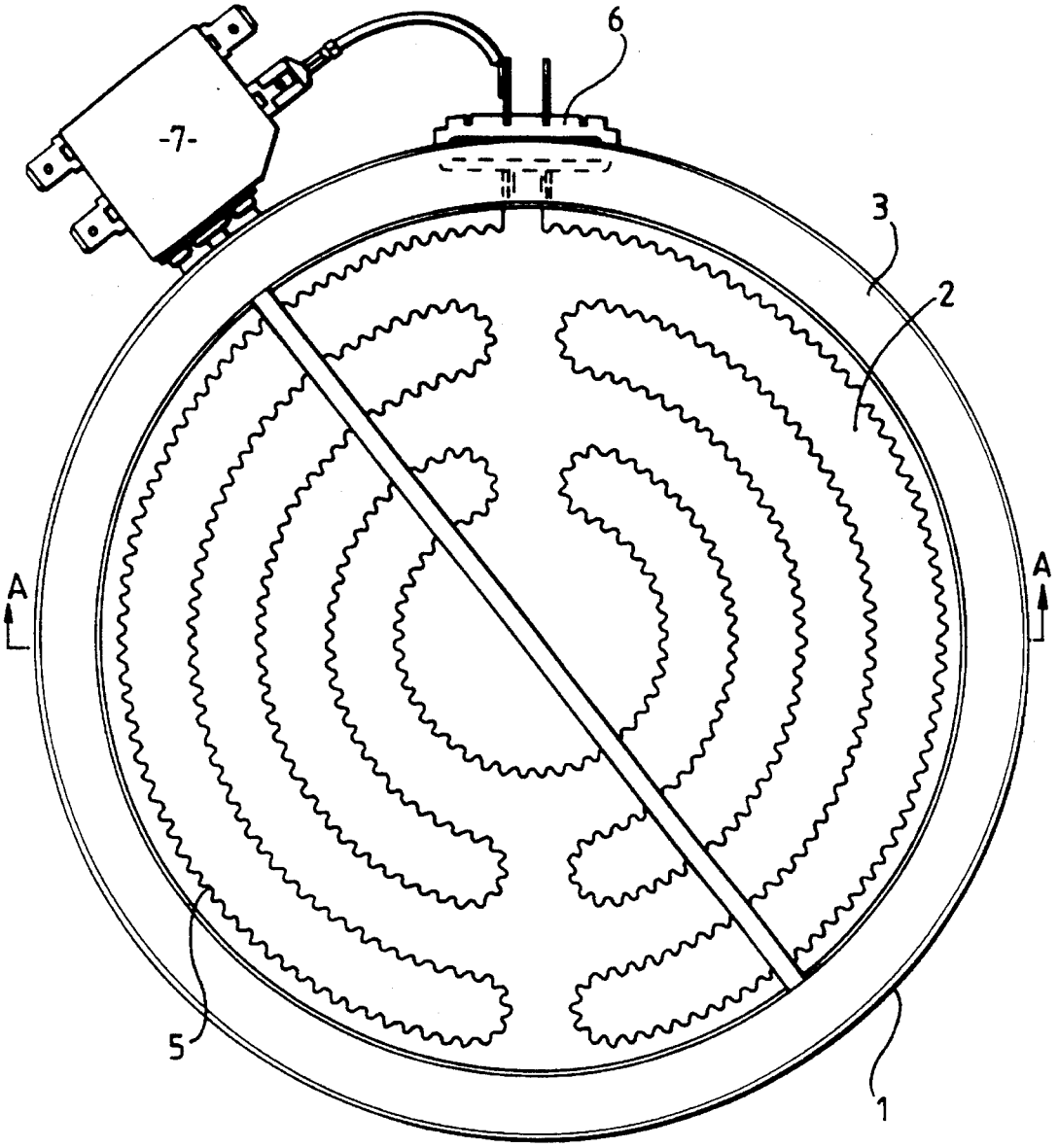
FIG. 3 is a plan view of a radiant electric heater comprising the components of FIGS. 1 and 2 and made by the method according to the present invention.

A heating element 4 is provided from an elongate strip 5 of a metal or metal alloy, such as an iron-chromium-aluminium alloy, having a thickness of, for example, 0.05 to 0.2 mm and a height h of, for example, 3 to 6 mm. However, if desired, the edge of the elongate strip 5 may be profiled or provided with tabs for embedding in the base layer 2 of compacted microporous thermal and electrical insulation material. The strip 5 itself is provided in corrugated form (sometimes also known as sinuous, serpentine or convoluted form) and is bent into the desired shape for the heating element as shown in FIG. 1, using techniques well known in the art. It should be noted, however, that the dimensions of thickness of the strip quoted above are for the strip before making into corrugated form. The resulting heating element 4 is located in contact with the surface of the base 2 of microporous thermal and electrical insulation material and pressure is applied uniformly to the heating element 4 to urge the strip material 5 thereof edgewise into the base 2 and thereby cause the heating element 4 to become securely embedded in the base 2 to a depth corresponding to at least part of the height h of the strip 5. The heating element 4 is preferably embedded in the base 2 of microporous insulation material to not more than 50 per cent of the height h of the strip 5. A terminal connector 6 is provided for electrically connecting the heating element 4 to an electrical supply, for operation thereof.

Against the side of the dish 1 is located a peripheral wall 3 of thermal insulation material, such as a ceramic fibre material made from aluminosilicate fibres or alternatively microporous insulation material.

A well-known form of thermal cut-out device 7 is provided, extending over the heating element 4, to switch off the heating element in the event of over-heating of the glass-ceramic cooking surface when the heater is installed and operating in a cooking appliance having such a glass-ceramic cooking surface.

The provision of the compacted layer may, if desired, involve more than one process stage. In a first stage, the base 2 may be formed by compacting the layer of microporous insulation material in the dish 1 to less than its desired final compaction density; and then in a second stage during or after urging the strip 5 into the base, further compaction of the microporous insulation material may be effected to obtain the desired final compaction density for the base 2.

I claim:

1. A method of manufacturing a radiant electric heater comprising: providing a base of microporous thermal and electrical insulation material having a substantially continuous surface; providing a heating element in the form of an elongate electrically conductive strip having a predetermined height; and urging the strip edgewise into the continuous surface of the base of microporous thermal and electrical insulation material so as to embed and support the strip edgewise therein along substantially the entire length of the strip to a depth corresponding to part of the height of the strip.

2. A method according to claim 1, wherein the electrically conductive strip is provided in corrugated form along its length.

3. A method according to claim 1, wherein the strip is embedded such that a significant proportion of the height thereof protrudes from the base of microporous insulation material.

4. A method according to claim 1, wherein the base of microporous insulation material is provided as a compacted layer inside a supporting dish.

5. A method according to claim 1, wherein the base of microporous insulation material is formed with a surface of substantially planar form into which the strip is urged.

6. A method according to claim 1, wherein the strip comprises a metal or a metal alloy.

7. A method according to claim 6, wherein the alloy comprises an iron-chromium-aluminium alloy.

8. A method of manufacturing a radiant electric heater comprising: providing a supporting dish to receive a thermal insulation material; compacting microporous thermal and electrical insulation material in the dish to form a base having a substantially continuous surface and a density less than a final compaction density thereof; providing a heating element in the form of an elongate, electrically conductive strip having a predetermined height; urging the strip edgewise into the continuous surface of the base of microporous thermal and electrical insulation material so as to embed and support the strip edgewise therein along substantially the entire length of the strip to a depth corresponding to part of the height of the strip; and further compacting the microporous insulation material, during or subsequent to urging the strip into the base, to obtain the final compaction density.

* * * * *